US008127754B1

(12) United States Patent
Johnson et al.

(10) Patent No.: US 8,127,754 B1
(45) Date of Patent: Mar. 6, 2012

(54) TOY MULTIPLE BARREL GUN

(75) Inventors: Brownie Johnson, Kowloon (CN); Chor-Ming Ma, Kowloon (CN)

(73) Assignee: Buzz Bee Toys (H.K.) Co., Limited, Kowloon, Hong Kong (CN)

( * ) Notice: Subject to any disclaimer, the term of this patent is extended or adjusted under 35 U.S.C. 154(b) by 0 days.

(21) Appl. No.: 12/971,356

(22) Filed: Dec. 17, 2010

(30) Foreign Application Priority Data

Oct. 14, 2010 (HK) ..... 10109758

(51) Int. Cl.
*F41B 11/00* (2006.01)

(52) U.S. Cl. ..... 124/66

(58) Field of Classification Search ..... 124/66, 124/71–77; 42/54; 446/473; 89/1.41
See application file for complete search history.

(56) References Cited

U.S. PATENT DOCUMENTS 36,836 A * 11/1862 Gatling ..... 89/12
3,437,005 A * 4/1969 Trumper ..... 89/33.02
3,688,637 A * 9/1972 Tan ..... 89/12
3,698,283 A * 10/1972 Ashley et al. ..... 89/12
3,706,259 A * 12/1972 Ashley et al. ..... 89/12
3,741,069 A * 6/1973 Stewart et al. ..... 89/11
3,760,683 A * 9/1973 Seemann ..... 89/12
4,216,698 A * 8/1980 Chiabrandy ..... 89/12
4,834,058 A * 5/1989 Gegere ..... 124/29
4,841,835 A * 6/1989 Bohler et al. ..... 89/12
5,213,089 A * 5/1993 DeLuca ..... 124/29
5,283,970 A * 2/1994 Aigner ..... 42/57
6,443,044 B1 * 9/2002 Dillon ..... 89/12
7,146,898 B2 * 12/2006 O'Dwyer ..... 89/12
7,458,371 B2 * 12/2008 Ong et al. ..... 124/65
2005/0262996 A1 * 12/2005 O'Dwyer ..... 89/12

* cited by examiner

*Primary Examiner* — Troy Chambers
(74) *Attorney, Agent, or Firm* — Alix, Yale & Ristas, LLP

(57) ABSTRACT

A toy gun includes a body, a pinion located in the body and a turning member mounted to rotate about the pinion. A number of barrels each rotate upon the turning member at radial positions. Each barrel has a gear meshing with the pinion. Each barrel has a circular array of projectile-receiving tubes. An indexing mechanism causes the turning member to rotate about the axis whereupon the meshing interaction of the gears with the pinion causes orbital movement of the barrels about the axis as they rotate with respect to the turning member. As a result, each projectile-receiving tube is delivered to the firing position.

7 Claims, 2 Drawing Sheets

TOY MULTIPLE BARREL GUN

BACKGROUND OF THE INVENTION

The present invention relates to toy guns. The invention more particularly, although not exclusively, relates to toy guns for shooting a multitude of preloaded soft projectiles.

Conventional toy guns designed for loading a multitude of soft projectiles or "darts" generally provide either magazine-loading, or a rotating barrel having a circular array of projectile-receiving tubes located just inboard of the barrel periphery. In this latter type, if the number of projectiles is to be high, the toy must be designed to have a barrel of large diameter to provide more loading tubes. This results in a toy gun that is wide and bulky.

OBJECTS OF THE INVENTION

It is an object of the present invention to overcome or substantially ameliorate the above disadvantage and/or more generally to provide an improved toy gun.

DISCLOSURE OF THE INVENTION

There is disclosed herein a toy gun, comprising:

a body including a projectile-firing position;

a pinion located within the body and having a longitudinal axis;

a turning member mounted to rotate about said longitudinal axis;

a plurality of barrels each rotatably mounted to the turning member at a position radially outward of said longitudinal axis, each barrel having a gear meshing with the pinion, each barrel having a plurality of projectile-receiving tubes; and an indexing mechanism causing the turning member to rotate about said longitudinal axis whereupon said meshing interaction of the gears and the pinion results in orbital movement of the barrels about said longitudinal axis as the barrels rotate with respect to the turning member such that each projectile-receiving tube is delivered to said projectile-firing position.

Preferably, the pinion is fixed with respect to or formed integrally with a fixed shaft and wherein the turning member is a disk mounted to rotate upon said fixed shaft.

Preferably, the toy gun further comprises an advancing pulley mounted upon the fixed shaft and adapted to rotate relative to the disk in one direction only.

Preferably, the toy gun further comprises a string wrapped about the advancing pulley, and a cocking handle mounted upon the body to which the string is attached.

Preferably, the toy gun further comprises an indexing stopper attached to the body and biased against the periphery of the disk.

Preferably, the toy gun further comprises a torsion spring connected between the fixed shaft and the advancing pulley to return the advancing pulley and the cocking handle to respective rest positions.

Preferably, the toy gun further comprises an air nozzle aligned with the firing position and a spring-loaded piston adapted to force air rapidly through the nozzle and into whichever said projectile-receiving tube is delivered to said firing position.

An advantage of this system is that it will save space.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figures 1A, 1B, 1C, 1D, 2A, 2B, 2C, 2D, 3A, 3B, 3C, 3D, 4A, 4B, 4C, 4D:
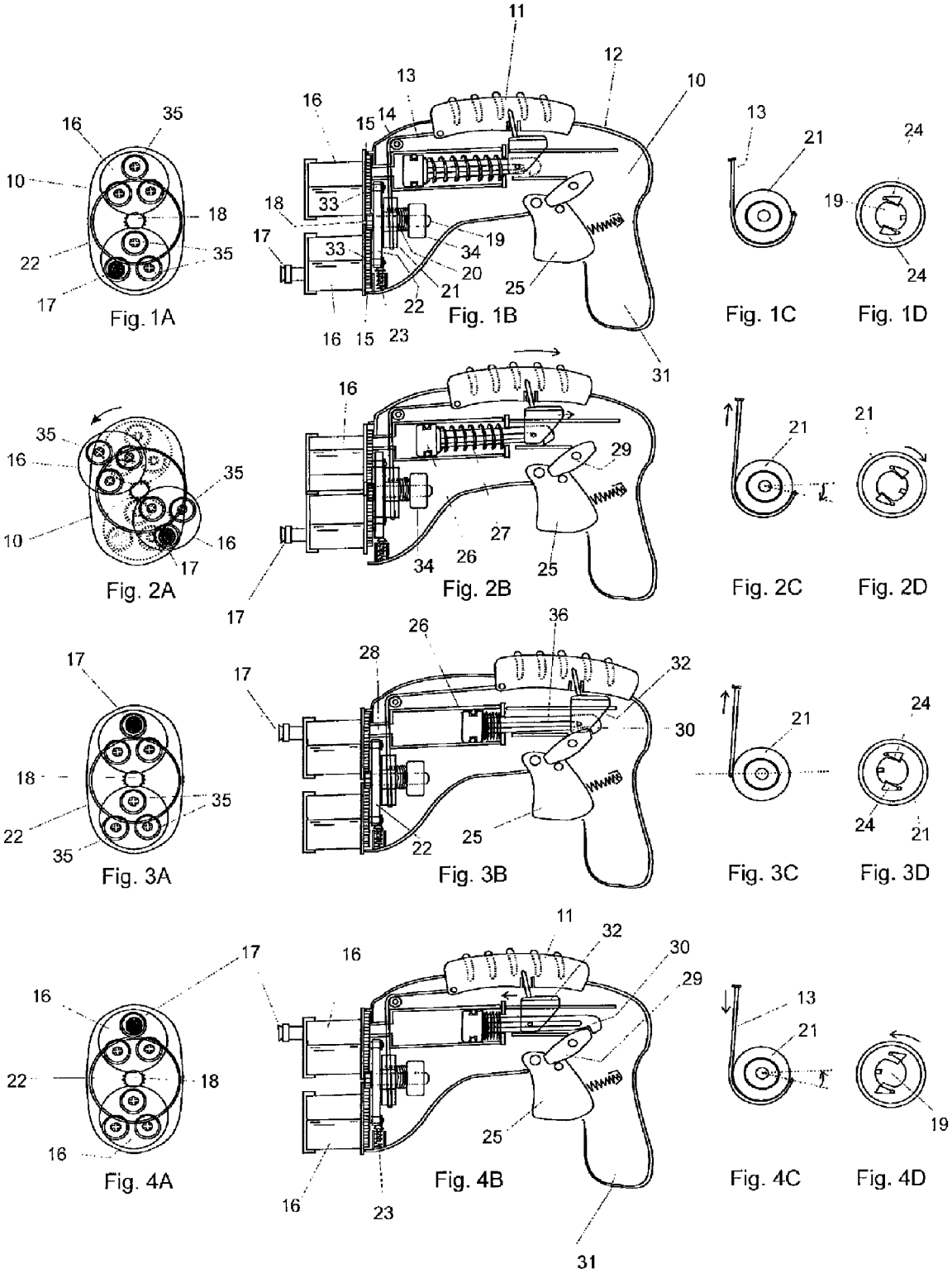
FIG. 1A is a schematic end elevation of the front portion of a toy gun having a pair of orbital rotating barrels in a primary rest position.
FIG. 1B is a schematic cross-sectional side elevation of the toy gun in the configuration of FIG. 1A.
FIG. 1C is a schematic elevation of an advancing pulley and string in the configuration of FIGS. 1A and 1B.
FIG. 1D is a schematic elevation of the clutch mechanism in the configuration of FIGS. 1A to 1C.
FIGS. 2A to 2D repeat FIGS. 1A to 1D in a configuration corresponding to that at which the cocking handle is partially retracted.
FIGS. 3A to 3D repeat FIGS. 1A to 1D in a configuration corresponding to that at which the cocking handle is fully retracted.
FIGS. 4A to 4D repeat FIGS. 1A to 1D in a configuration corresponding to that at which the cocking handle is returning to the primary rest position.
Figure 5A:
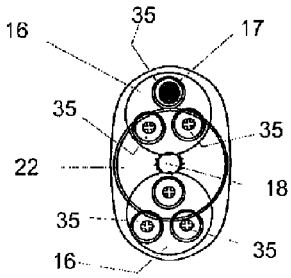
FIGS. 5A to 5D repeat FIGS. 1A to 1D in a configuration corresponding to that at which the cocking handle has returned to the primary rest position.
Figure 5B:
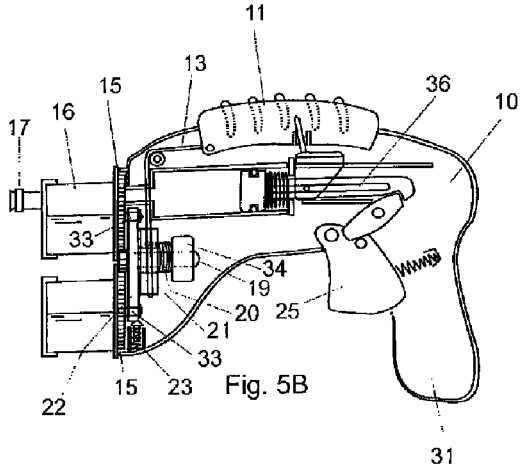
Figure 5C:
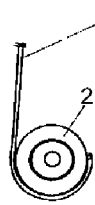
Figure 5D:
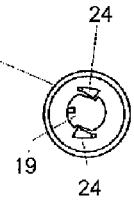
Figure 6A:
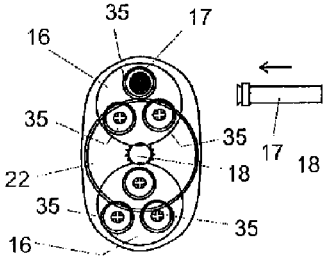
FIGS. 6A to 6D repeat FIGS. 1A to 1D in a configuration corresponding to that at which the trigger has been activated to eject a projectile.
Figure 6B:
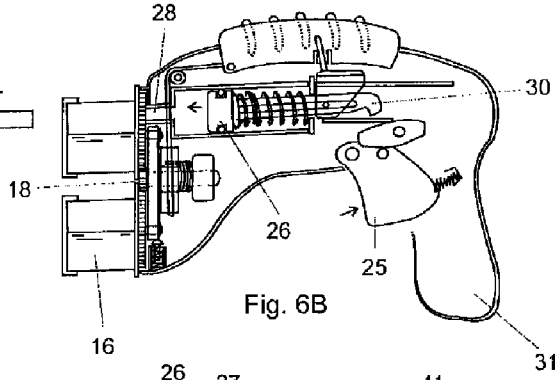
Figure 6C:
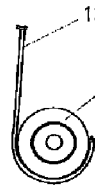
Figure 6D:
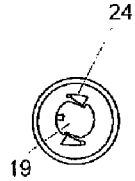
Figure 7A:
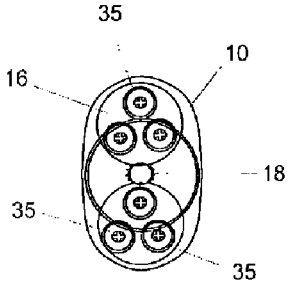
FIGS. 7A to 7D repeat FIGS. 1A to 1D in a configuration after having returned to the primary rest position after firing.
Figure 7B:
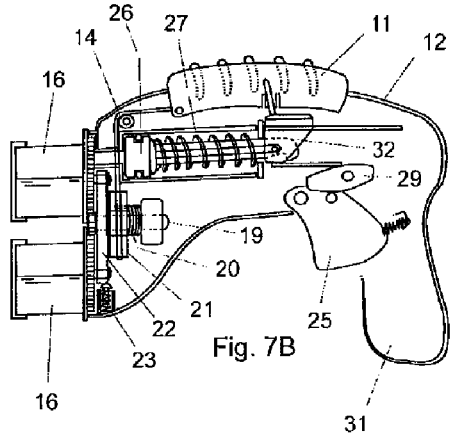
Figure 7C:
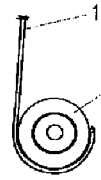
Figure 7D:
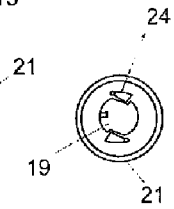

In the accompanying drawings there is depicted schematically a toy gun comprising the body 10 having a cocking handle 11 which slides upon a curved track 12 at the top of the body. A string 13 is attached to the cocking handle 11 and passes about an idling pulley 14 to an advancing pulley 21.

The advancing pulley 21 rotates about a fixed shaft 19 which is fixed to a mount 34 at its tail end. The central axis of the fixed shaft 19 extends in the longitudinal direction of the gun body 10. Also rotating about the fixed shaft 19 is a turning member in the form of a disk 22. The turning member 22 is fixed to the advancing pulley 21 so as to rotate therewith. A torsion spring 20 is wrapped about the fixed shaft 19 and has one end attached to the mount 34. The other end of the torsion spring 20 is interlocked with the advancing pulley 21. The purpose of the torsion spring 20 is to return the cocking handle 11 to its initial position.

A clutch mechanism is provided upon the shaft 19 to ensure that the advancing pulley 21 can rotate in one direction only. To this end, resilient wedge-shaped gripping pawls 24 are located in wedge formations formed at the periphery of the fixed shaft 19. These bear against an internal surface of the advancing pulley 21.

An indexing stopper 23 is provided near the bottom of the body 10 and comprises a spring-biased button which engages the periphery of the turning member 22. The periphery of the turning member 22 might include detents at predefined indexing positions resulting in the turning member clicking into precise angular positions.

At the front of the gun body 10, there is provided a pair of barrels 16. Each barrel 16 has three projectile-receiving tubes 35 in a circular array spaced radially about a respective barrel axis. For the purpose of illustration, only a single projectile 17 is shown loaded into one of the tubes 35.

The barrel axes are parallel to the longitudinal axis of the fixed shaft 19 and pass centrally through respective barrel axles 33. The barrel axles 33 are received within respective apertures of the turning member 22 near its periphery.

Each barrel 16 has a peripheral gear 15 centred about its axle 33. The gears 15 of both barrels 16 mesh with the fixed pinion 18.

The cocking handle 11 is connected to a carriage 32. The carriage 32 has a pin which fits into a longitudinal slot 36 formed in a piston 26. The tail end of the piston 26 includes a hook 30. A firing spring 27 compresses behind the piston 26 as the cocking handle 11 is drawn back. Forward of the piston 26 is a nozzle 28 through which air passes rapidly upon firing to present to a firing position behind the projectile 17 to cause it to fire from the toy gun.

The toy gun also includes a grab handle 31 and a trigger 25 pivotally mounted to the body 10. A lever 29 interacts with the trigger 25 and the hook 30. When the trigger 25 is depressed, the lever 29 pivots to disengage from the hook 30 to allow the piston 26 to move rapidly forward under the force of spring 27.

Each time a player moves the cocking handle 11 to load the pump system, the barrels 16 will orbit about the fixed shaft 19 and fixed pinion 18. Due to meshing of the barrel gears 15 and the fixed pinion 18, the barrels 16 will rotate about their own axes (barrel axles 33). This rotation will cause each barrel 16 to change its angular orientation to thereby successively align each projectile-receiving tube 35 with the air nozzle 28 as illustrated sequentially through the figures. By correct implementation of gear ratios, the expected angular increment can be achieved.

It should be appreciated that modifications and alterations obvious to those skilled in the art are not to be considered as beyond the scope of the present invention. For example, whilst the preferred embodiment depicts only a pair of barrels as an example, larger numbers of orbital barrels can be accommodated. Furthermore, although the depict embodiment has just three projectile-receiving tubes per barrel, it will be up to the designer to determine an appropriate number of projectile-receiving tubes per barrel in concordance with the selected gearing calculation. Also, whilst a particular string/pulley mechanism has been exemplified, there are numerous alternative means of causing barrel rotation. For example, gears and wedge-in-slot mechanisms could be adopted without departing from the scope of the invention. Also, rather than providing a clutch mechanism and a separate indexing stopper, a single ratchet mechanism could be adopted.

The invention claimed is:

1. A toy gun, comprising:

a body including a projectile-firing position;

a pinion located within the body and having a longitudinal axis;

a turning member mounted to rotate about said longitudinal axis;

a plurality of barrels each rotatably mounted to the turning member at a position radially outward of said longitudinal axis, each barrel having a gear meshing with the pinion, each barrel having a plurality of projectile-receiving tubes; and an indexing mechanism causing the turning member to rotate about said longitudinal axis whereupon said meshing interaction of the gears and the pinion results in orbital movement of the barrels about said longitudinal axis as the barrels rotate with respect to the turning member such that each projectile-receiving tube is delivered to said projectile-firing position.

2. The toy gun of claim 1, wherein the pinion is fixed with respect to or formed integrally with a fixed shaft and wherein the turning member is a disk mounted to rotate upon said fixed shaft.

3. The toy gun claim 2, further comprising an advancing pulley mounted upon the fixed shaft and adapted to rotate relative to the disk in one direction only.

4. The toy gun of claim 3, further comprising a string wrapped about the advancing pulley, and a cocking handle mounted upon the body to which the string is attached.

5. The toy gun of claim 2, further comprising an indexing stopper attached to the body and biased against the periphery of the disk.

6. The toy gun of claim 4, further comprising a torsion spring connected between the fixed shaft and the advancing pulley to return the advancing pulley and the cocking handle to respective rest positions.

7. The toy gun of claim 1, further comprising an air nozzle aligned with the firing position and a spring-loaded piston adapted to force air rapidly through the nozzle and into whichever said projectile-receiving tube is delivered to said firing position.

* * * * *